US009051785B2

(12) United States Patent
Mackenzie et al.

(10) Patent No.: US 9,051,785 B2
(45) **Date of Patent: *Jun. 9, 2015**

(54) OIL AND GAS RISER SPIDER WITH LOW FREQUENCY ANTENNA APPARATUS AND METHOD

(71) Applicant: Vetco Gray Inc., Houston, TX (US)

(72) Inventors: Patricia Mackenzie, Clifton Park, NY (US); Judith Ann Guzzo, Niskayuma, NY (US); Lynn Ann DeRose, Gloversville, NY (US); Brandon Stephen Good, Schenectady, NY (US)

(73) Assignee: Vetco Gray Inc., Houston, TX (US)

( * ) Notice: Subject to any disclaimer, the term of this patent is extended or adjusted under 35 U.S.C. 154(b) by 70 days.

This patent is subject to a terminal disclaimer.

(21) Appl. No.: 14/079,143

(22) Filed: Nov. 13, 2013

(65) Prior Publication Data

US 2014/0060851 A1 Mar. 6, 2014

Related U.S. Application Data

(63) Continuation-in-part of application No. 13/919,573, filed on Jun. 17, 2013, now abandoned, and a continuation of application No. 12/710,707, filed on Feb. 23, 2010, now Pat. No. 8,464,946, and a continuation of application No. 13/707,121, filed on Dec. 6, 2012, now Pat. No. 8,708,052, and a continuation of application No. 13/300,155, filed on Nov. 18, 2011, now Pat. No. 8,540,030, and a continuation of application No. 12/029,376, filed on Feb. 11, 2008, now Pat. No. 8,074,720.

(51) Int. Cl.

| | |
|---|---|
| ***G06F 17/00*** | (2006.01) |
| ***E21B 17/00*** | (2006.01) |
| ***E21B 19/00*** | (2006.01) |
| ***E21B 47/12*** | (2012.01) |
| ***E21B 17/01*** | (2006.01) |
| ***E21B 19/10*** | (2006.01) |

(52) U.S. Cl.

CPC ..... *E21B 17/006* (2013.01); *E21B 19/004* (2013.01); *E21B 47/122* (2013.01); *E21B 17/01* (2013.01); *E21B 19/10* (2013.01)

(58) Field of Classification Search

None

See application file for complete search history.

(56) References Cited

U.S. PATENT DOCUMENTS

| | | | |
|---|---|---|---|
| 4,205,379 | A | 5/1980 | Fox et al. |
| 4,317,174 | A | 2/1982 | Dean |

(Continued)

OTHER PUBLICATIONS

Chedzoy, C. et al., Design Challenges of Deepwater Dry Tree Riser Systems for Different Vessel Types, 2003.

(Continued)

*Primary Examiner* — Michael G Lee
*Assistant Examiner* — Tabitha Chedekel
(74) *Attorney, Agent, or Firm* — Bracewell & Giuliani LLP

(57) ABSTRACT

Apparatus and methods for tracking a plurality of marine riser assets are provided. Part of a riser lifecycle monitoring system, the apparatus can include an oil and gas riser spider to connect a plurality of riser pipe sections during assembly of a riser pipe string. The riser spider forms an annulus around a first section of the plurality of riser pipe sections and supports the first section of the plurality of riser pipe sections during connection to a second section. The apparatus can also include a reader including an antenna arrangement to read a plurality of radio frequency identification tags, e.g., directional 125 kHz RFD tags, attached to or embedded within an outer surface portion of each of the plurality of riser pipe sections.

22 Claims, 8 Drawing Sheets

(56) References Cited

U.S. PATENT DOCUMENTS

| | | | |
|---|---|---|---|
| 5,088,859 | A | 2/1992 | Devlin |
| 5,202,680 | A | 4/1993 | Savage |
| 5,240,446 | A | 8/1993 | Boatman et al. |
| 5,372,531 | A | 12/1994 | Boatman et al. |
| 5,553,504 | A | 9/1996 | Lyons et al. |
| 5,777,239 | A | 7/1998 | Fuglewicz |
| 5,978,739 | A | 11/1999 | Stockton |
| 6,364,021 | B1 | 4/2002 | Coats |
| 6,588,985 | B1 | 7/2003 | Bernard |
| 6,932,542 | B2 | 8/2005 | Chianis et al. |
| 7,080,689 | B2 | 7/2006 | Guesnon |
| 7,194,913 | B2 | 3/2007 | Morrison et al. |
| 7,252,159 | B2 | 8/2007 | Baek |
| 7,328,741 | B2 | 2/2008 | Allen et al. |
| 7,540,200 | B2 | 6/2009 | Yung et al. |
| 7,766,580 | B2 | 8/2010 | Dartford et al. |
| 8,074,720 | B2 | 12/2011 | Radi |
| 8,464,946 | B2 * | 6/2013 | Mackenzie et al. ..... 235/385 |
| 8,540,030 | B2 | 9/2013 | Radi |
| 2005/0100414 | A1 | 5/2005 | Salama |
| 2008/0289876 | A1 | 11/2008 | King |
| 2013/0092387 | A1 | 4/2013 | Radi |

OTHER PUBLICATIONS

International Search Report and Written Opinion for related PCT Application PCT/US09/33826, Apr. 2007.

* cited by examiner

OIL AND GAS RISER SPIDER WITH LOW FREQUENCY ANTENNA APPARATUS AND METHOD

RELATED APPLICATIONS

This application is a continuation-in-part of and claims priority to and the benefit of U.S. patent application Ser. No. 13/919,573, titled "Oil and Gas Riser Spider with Low-Frequency Antenna Apparatus and Method," which is a continuation of and claims priority to and the benefit of U.S. patent application Ser. No. 12/710,707, titled "Oil and Gas Riser Spider with Low-Frequency Antenna Apparatus and Method"; and U.S. patent application Ser. No. 13/707,121, titled "Riser Lifecycle Management System, Computer Readable Medium and Program Code," which claims priority to and the benefit of U.S. application Ser. No. 13/300,155, titled "Riser Lifecycle Management System, Program Product, and Related Methods," which claims priority to and the benefit U.S. patent application Ser. No. 12/029,376, titled "Riser Lifecycle Management System, Program Product, and Related Methods," filed on Feb. 11, 2008, now U.S. Pat. No. 8,074,720, and is related to co-owned U.S. Pat. No. 7,328,741 B2, titled "System for Sensing Riser Motion" issued on Feb. 12, 2008, each incorporated herein by reference in its entirety.

BACKGROUND OF THE INVENTION

1. Field of the Invention

The present invention relates to the oil and gas industry. More particularly, the present invention relates to an oil and gas spider apparatus with a built-in antenna arrangement and related methods for use in a riser management system that monitors and manages a plurality of marine riser assets having identification tags through utilization of the spider apparatus.

2. Description of Related Art

In the oil and gas industry, a riser is a string of pipe between the sea bottom and ship or rig. Oil and gas riser pipe strings are assembled using a device known as a "spider." The spider feeds and connects each section of riser pipe in the string. Spiders can have different configurations. Some spiders are made of a solid ring that the riser feeds through; some spiders are made of two pieces that close around a riser pipe and then feed the riser pipe through. For each configuration type of spider, the riser pipes are all fed into the spider in the same orientation.

During a typical field installation at sea, marine riser components are individually lifted. from the deck of a vessel, connected to each other at the riser spider, and run down. Riser joints, which comprise the major length of the riser string, are fabricated in lengths ranging from 50' to 90'. During the running procedure, the portion of the riser string that is fully made up is landed on the riser spider. The next riser joint is then picked up and placed just over the spider, immediately above the suspended riser string. The two riser sections are then joined by means of a mechanical connector.

Riser Lifecycle Management Systems (RLMS) have been described, such as in co-owned U.S. Pat. No. 8,074,720. Such riser lifecycle management systems, for example, can provide asset managers a list of all the riser assets allocated to specific vessels and provide a further breakdown of those assets that are currently deployed, are on deck, or are out for maintenance, along with the expected return date; a list of upcoming scheduled maintenance events; an estimate of the amount of operational life being expanded by a particular riser asset; and an estimate of the total amount of operational life used by a particular riser asset, along with the details of the most damaging events (i.e., a certain hurricane event). Such riser lifecycle management systems can include, for example, a central database that can be used by field and maintenance personnel to maintain and communicate critical riser information, and that can enhance both routine maintenance scheduling and identifying a need for an unscheduled maintenance event.

Conventional stationary readers associated with a riser spider can interfere with normal operation of the spider. For example, known designs can require contact of an antenna and tag. Other conventional designs may call for the reader to be positioned too far away from the tag to be read without substantial loss in tag signal or data collisions from other adjacent tags if the tags do not include anti-collision provisions. Currently, directional 125 kHz RFID tags are being embedded in drill pipes and read using a handheld reader in a manual process.

Conventionally, directional 125 kHz RFID tags are being embedded in drill pipes and read using a handheld reader in a manual process.

SUMMARY OF THE INVENTION

In view of the foregoing, Applicants recognize that a manual process for reading riser pipes is error-prone and expensive. Moreover, Applicants recognize the need for apparatuses and related methods for automatically reading riser pipes, without requiring hand-held readers, manual processes, or interference with normal operations. Specifically, Applicants recognize that a low frequency (LF), stationary reader antenna assembly built into a spider would allow riser pipes to be read automatically, as the pipes are loaded. Moreover, Applicants recognize the advantages of an antenna configuration for various spider designs, including both ring and two-piece spiders. Accordingly, embodiments of the present invention advantageously provide an oil and gas spider apparatus with a built-in antenna assembly and related methods. Various embodiments can, for example, enhance a riser management system that monitors and manages a plurality of riser assets, e.g., marine riser assets such as, for example, riser pipes, drilling pipes, or other tubulars capable of fitting through the spider apparatus.

Various embodiments of the present invention include, for example, an apparatus. The apparatus can include a riser spider to connect a plurality of riser pipe sections during assembly of a riser pipe string. The riser spider can be positioned to form an annulus around a first section of the plurality of riser pipe sections and to support the first section of the plurality of riser pipe sections during connection to a second section of the plurality of riser pipe sections. The apparatus can include an antenna to read a plurality of radio frequency identification tags attached to or embedded within outer surface portions of the plurality of riser pipe sections. The antenna can be a single antenna or part of an antenna assembly. According to a configuration, the antenna includes an oblong loop attached to and substantially spanning about half of an internal surface of the riser spider so that the antenna follows the contour of the riser spider. In this configuration, the riser normally carries at least two identification tags (e.g., RFID tags) radially separated from each other by at least approximately 90°. According to another configuration, a second similar hemispherical extending loop is on a second section of a split section riser spider.

According to another configuration, the antenna includes an oblong loop substantially spanning the entire inner circumference of a portion of the riser spider. According to yet another configuration, a plurality of loop antennas are positioned along an inner circumference of either a single-piece spider or a split section riser spider to form an antenna arrangement. According to further configurations, the antenna design can be of various geometric shapes configured to provide mutual coverage along the longitudinal axis of the riser spider so that a marine tabular having a single identification tag connected to or embedded within it surface and passing through the riser spider will pass along one of the antenna and be read by an associated reader. That is, the antenna arrangement configuration can provide 360° coverage, allowing the tubular to pass through with its identification tag at any radial position (orientation) and still be read with a high degree of confidence.

Various embodiments of the present invention can include, for example, a method of tracking marine riser pipe sections. The method can include, for example, providing a plurality of radio frequency identification tags attached to outsides of and associated with a plurality of riser pipe sections. The method can include, for example, utilizing a riser spider to connect the plurality of riser pipe sections during assembly of a riser pipe string or connecting drill pipe to form a drilling string. The riser spider can form an annulus around a first section of the plurality of riser pipe sections and support the first section of the plurality of riser pipe sections during connection to a second section of the plurality of riser pipe sections. The method can include, for example, reading each of the plurality of, e.g., radio frequency identification tags during a feeding of the associated riser pipe section through the riser spider utilizing an antenna or antenna arrangement described above. The antenna or antenna arrangement can be such that the plurality of identification tags are read regardless of their radial position with respect to the riser spider when being operationally deployed.

Various embodiments of the present invention can further include, for example, a method of tracking a plurality of riser pipe sections. The method can include, for example, for each of a plurality of riser pipe sections, receiving riser pipe section identification data from a radio frequency identification tag attached to or embedded within an outside surface of and associated with a riser pipe section utilizing a single antenna or antenna assembly during a feeding of the riser pipe section through a riser spider during assembly of a riser pipe string to separately identify each one of the plurality of riser pipe sections from each other of the plurality of riser pipe sections. The antenna or antenna arrangement can be such that the plurality of identification tags are read regardless of their radial position with respect to the riser spider when being operationally deployed. The method can include, for example, determining a relative deployed position location of the each of the plurality of riser pipe sections to form the riser pipe string.

Other prior solutions require hand-held or stationary readers that alter or interfere with normal operation of the riser pipe string. Various embodiments of the invention negate the need for handheld readers and beneficially do not interfere with the normal operation of either the riser spider or deployment of the riser pipe or drilling string. In addition, embodiments of the present invention advantageously provide a solution for various riser spider configurations, including spiders that are made of two pieces that close around a riser pipe.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art.

Applicants recognize that a manual process for reading riser pipes is error-prone and expensive. Moreover, Applicants recognize the need for apparatuses and related methods for automatically reading riser pipes, without requiring handheld readers, manual processes, or interference with normal operations. Specifically, Applicants recognize that a low frequency (LF), stationary reader antenna built into a riser spider would allow riser pipes to be read automatically, as the pipes are fed through the riser spider. Moreover, Applicants recognize the advantages of an antenna for various spider designs, including both ring and two-piece spiders. Accordingly, embodiments of the present invention advantageously provide an oil and gas spider apparatus with a built-in antenna and related methods. One or more embodiments can, for example, enhance a riser management system that monitors and manages a plurality of riser assets, e.g., marine riser assets, drill pipe assets, etc.

Figure 1:
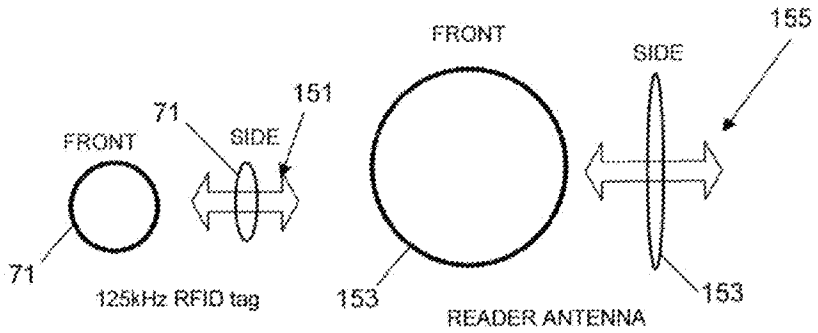
FIG. 1 are schematic views of the directional fields of an 125 kHz RFID tag and a reader antenna according to an embodiment of the present invention.
Figure 2:
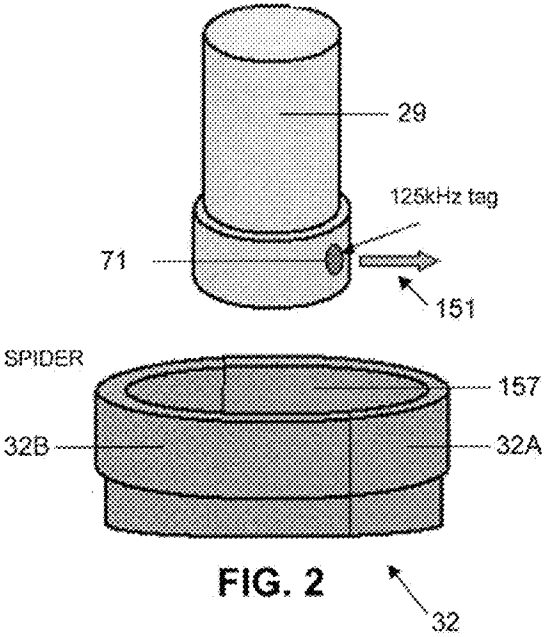
FIG. 2 is a perspective view of a riser and spider setup according to an embodiment of the present invention.

One or more embodiments of the present invention include, for example, RFID tags, e.g., 125 kHz RFID tags. As illustrated in FIG. 1, exemplary 125 kHz RFID tags 71 can be directional and can only he read on one side, defining a read field 151. As further illustrated in FIG. 1, a reader antenna 153 face the 125 kHz RFID tags 71 so that its read field 155 is directed toward the antenna 153. Accordingly, such embodiment or embodiments can include one or more directional RFID tags 71, as illustrated in FIG. 2, being positioned on a deployable tubular, e.g., a riser pipe 29, so that the tag's read field 151 is directed outward. Applicants recognize that otherwise the read field 151 will be directed inward toward the pipe 29 and away from any reader, including, for example, an antenna arrangement built into a spider 32. A spider 32, which feeds and connects each section of riser pipe in the string, surrounds or envelopes each riser pipe as it is added to the string so that an inner surface 157 of the spider 32 faces the a directional RFID tag 71 positioned on a riser pipe 29 and directed outward. As further illustrated in FIG. 2, some spiders 32 are made of two pieces 32A, 32B that close around a riser pipe 29 and then feeds the riser pipe through. Note, although described primarily with respect to riser pipe 29, one of ordinary skill in the art would recognize that the riser spider 32 can also pass other tubulars such as, for example, drill pipe (not shown but represented by riser pipe 29), which typically has a diameter being smaller than that of riser pipe 29. As such, if configured with compatible identification tags as would be understood by those of ordinary skill in the art, the riser spider can be used to read and track those tubulars as well.

As illustrated in FIGS. 3A-3F, various embodiments of the present invention can include, for example, placement of an antenna arrangement comprising one or more antenna 161, 162, 163, 164, 165, and/or 166, on or embedded within an inner surface 157 of a spider 32, or a portion of spider 32A and/or 32B.

Figure 3A:
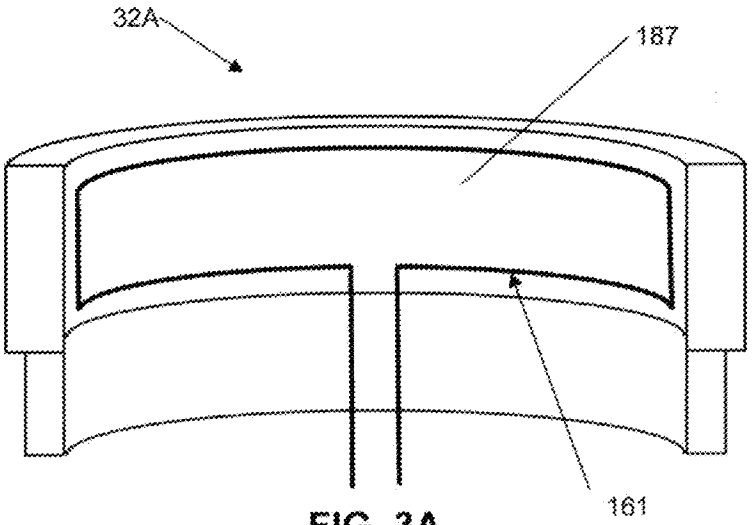
FIG. 3A is a perspective view of antenna placement according to an embodiment of the present invention.

As shown in FIG. 3A, an antenna embodiment or arrangement can include, for example, an oblong loop 161 that follows the contour of the spider 32, or a portion of spider 32A, such as, for example, an oblong loop 161 attached to and substantially spanning about half of an inner surface 157 of a riser spider 32, or about 180 degrees of the ring defined by the spider. As illustrated in FIG. 2, one piece 32A of a two-piece spider 32 can include an antenna embodiment or arrangement having an oblong loop 161 that follows the contour of the riser spider to thereby provide maximum readability. In various other configurations, the oblong loop 161 need not provide 180° coverage, however, one would expect less confidence that every tag 71 passing through would be read. As such, more than one tag 71 can be utilized and/or the user can ensure that the tubular passing through the riser spider 32 is in the rotational position needed for the tag 71 to pass within the read field 155 of the reader antenna 153.

In a typical arrangement, the distance between antenna need to be such that the antennas do not couple as would be understood by one of ordinary skill in the art. However, in order to provide 360° of coverage with 100% reliability when using multiple antenna, the antenna design requires the absence of a vertical line separation between antenna loops. Such a separation or gap could result in a missed reading of a tag 71 attached to its associated tubular (e.g., riser, drilling pipe) as it travels through the spider 32. As such, a desirable antenna design would include no vertical gap between antenna loops.

FIGS. 3B-3F illustrate antenna designs can be of various geometric shapes configured to provide mutual coverage along the longitudinal axis of the riser spider 32 so that a tubular (e.g., riser pipe 39) having a single identification tag 71 (or additional tags if desired) connected to or embedded within the surface of the tubular and passing through the riser spider will pass along one of the antenna and be read by an associated reader via the reader antenna 153. That is, the antenna arrangement configuration can provide 360° coverage, allowing the tubular to pass through with its identification tag 71 at any radial position (orientation) and still be read with a high degree of confidence.

Figure 3D:
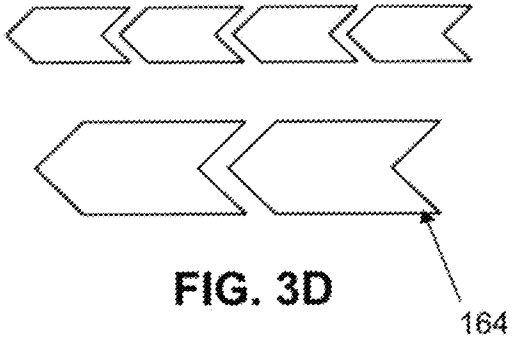
FIGS. 3B-3F are schematic views of antenna loops having different geometric shapes that provide overlapping coverage between adjacent antenna loops for enhanced read reliability according to an embodiment of the present invention.
Figure 3E:
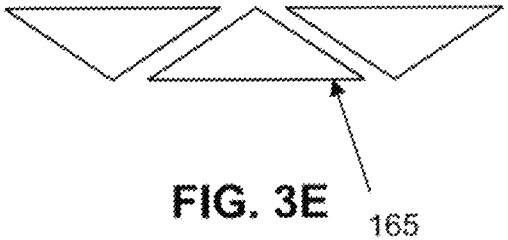
Figure 3B:
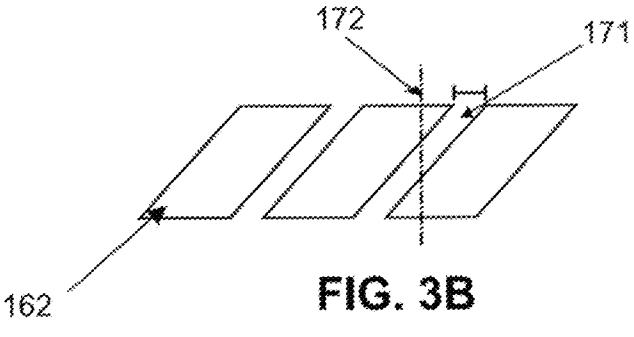

FIG. 3B, for example, illustrates an antenna arrangement having a plurality of parallelogram-shaped antenna 162 oriented so that the gap 171 does not provide a vertical pathway which a tag 71 may pass without being read. Dashed line 172 represents a vertical line illustrating that this particular antenna arrangement does not have any vertical pathways resulting from the gap 171. In this particular example, the tag will have to pass through the field 155 of at least one and possibly two of the antennae 162 in the arrangement. Note, the distance between antenna forming the gap 171 can be optimized during tuning at installation.

Figure 3C:
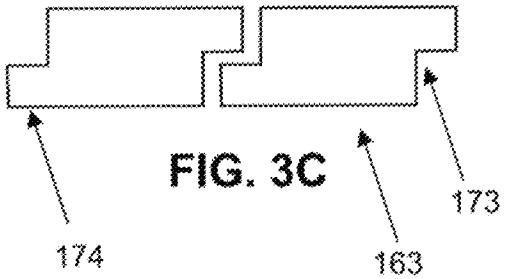

FIG. 3C illustrates an antenna 163 design having a more rectangular design but with an overhang 173 and foot 174 in order to overlap with adjacent antenna 163. FIG. 3D illustrates an antenna 164 design having the shape substantially in the form of the chevron to allow overlapping positioning with adjacent antenna 164. FIG. 3E illustrates an antenna 165 design having a triangular shape and having an alternating apex-up, apex-down in order to overlap with adjacent antenna 165.

Figure 3F:
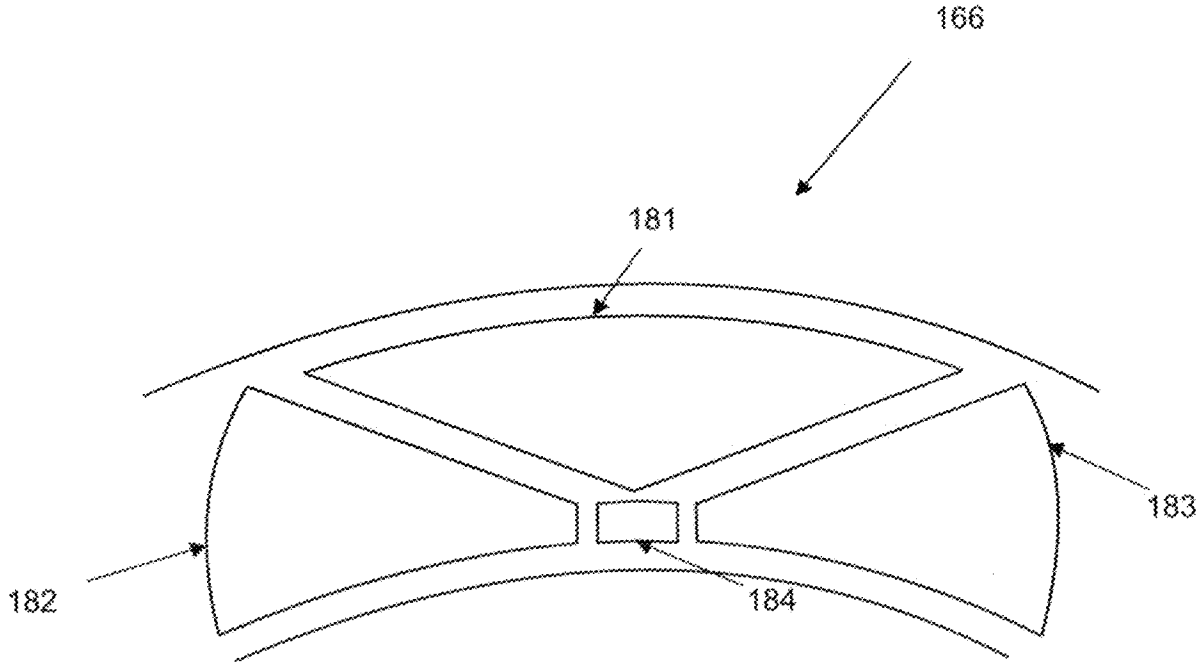

FIG. 3F provides an example of an antenna design 166 that can have multiple antenna loops 181-183 configured to cover one spider half 32A. The upper loop 181 can be in the form of a triangle. The lateral loops 182, 183, can be either triangular or frustoconical. Other combinations, however, are within the scope of the invention embodiments. Due to being on a spider half, a tag 71 could be missed in the space between the two spider halves 32A, 32B, due to a vertical gap between adjacent lateral loops 182, 183 for the respective spider halves 32A, 32B. To account for this, two or more tags 71 could be installed on the riser pipe 29 or other tubular, separated by at least the width of the gap to ensure read reliability. Additionally, if the antenna design 166 is used on only one of the spider halves 32A, 32B, as with either of the other antenna designs 161-165, two or more tags 71 with at least two of them spaced greater than 90° but less than 270° apart, can be installed to ensure read reliability.

FIG. 3F also illustrates an example of an antenna tuning board 184 used in both this antenna design 166 and in the previously described antenna designs 161-165. The antenna designs 161-166 will typically include one tuning board per antenna or one tuning board per two antennas, although other configurations are within the scope of the present invention.

Note, in the two-section riser spider 32 configuration, a vertical line separation can occur along the separation points, resulting in a reduction of reliability that a tubular having a single identification tag 71 will be read to about 96% when the rotational orientation is substantially random. Alternatively, according to one or more embodiments, portions of antenna loops can be connected across the splits between section 32A, 32B, through use of antenna bridges as would be understood by one of ordinary skill in the art.

Embodiments of the present invention also include, for example, an apparatus. The apparatus can include, for example, a riser spider 32 to connect a plurality of tubular sections, e.g., riser pipe sections 29, during assembly of, e.g., a riser pipe string. The riser spider 32 can form an annulus around a first section of the plurality of riser pipe sections and support the first section of the plurality of riser pipe sections during connection to a second section of the plurality of riser pipe sections. The apparatus can include, for example, an antenna arrangement including one or more of antenna 161, 162, 163, 164 165, and/or 166 to read a plurality of radio frequency identification tags 71 attached to, or embedded within, outer surface portions of the plurality of riser pipe sections 29. The antenna design can include an oblong loop 161 attached to and substantially spanning about half of an internal surface of the riser spider section 32A so that the antenna follows the contour of the riser spider, and/or a similar antenna design on the other riser spider section 32B. One or more of the other antenna arrangements using a plurality of antenna designs 162-165 or one or an opposing pair of antenna designs 166 can also or alternatively be used.

Figure 9:
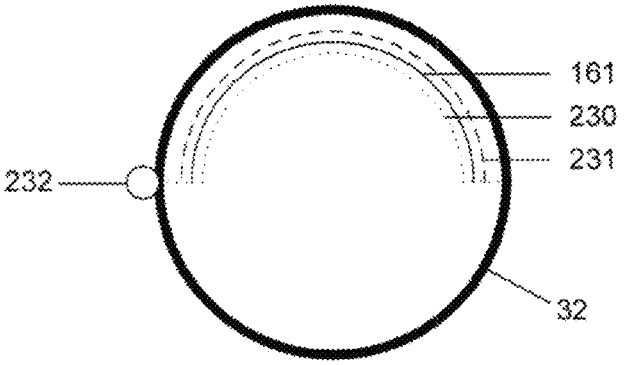
FIG. 9 is top view of a schematic block diagram of an apparatus according to an embodiment of the present invention.

The apparatus can also include an adhesive 231 (see, e.g., FIG. 9) to attach the antenna or antenna loops to the internal surface of the spider and a protectant 230 (see, e.g., FIG. 9) to protect the antenna from an ocean environment. The protectant 230 can seal the antenna or antennae to the spider inward facing surface or otherwise protect any exposed antenna or antenna component surfaces. An exemplary embodiment can include use of commercially available polyetheretherketone (PEEK) or marginalized epoxy resin for subsea applications. In other embodiments, attachment of the antenna to the spider can be through clamps, wiring, and other approaches as understood by those skilled in the art. The apparatus can also include a low-frequency, substantially stationary, passive reader 73 of radio frequency identification tags 71. (See, e.g., FIG. 7B,) The reader 73 can be operably connected to the reader's antenna arrangement.

In an example embodiment of an apparatus, the riser spider 32 can include two portions 32A, 32B that together close around the first section of the plurality of riser pipe sections 29 to form the annulus, with each portion comprising a semi-circumference of the annulus. The riser spider 32 can also include the two portions being connected by a hinge 232 (see, e.g., FIG. 9).

Placement of the antenna 161, 162, 163, 164, 165, and/or 166 on the inner surface 157 of the spider 32 allows the tag 71 on the riser pipe 29 to be read as it moves through the spider 32, automatically and without manually bringing a reader to the riser pipe 29 or the riser pipe 29 to a reader, for example. In addition, because no direct contact between the riser pipe 29 and the antenna 201 for the reader is necessary, the exemplary embodiments of the present invention beneficially do not interfere with normal operation of the riser pipe string.

Other prior solutions require hand-held or stationary readers, and necessarily alter or interfere with normal operation of the riser pipe string. In addition, embodiments of the present invention advantageously provide a solution for various riser spider configurations, including both uni-piece spiders and spiders that are made of two pieces that close around a riser pipe.

Figures 4, 5:
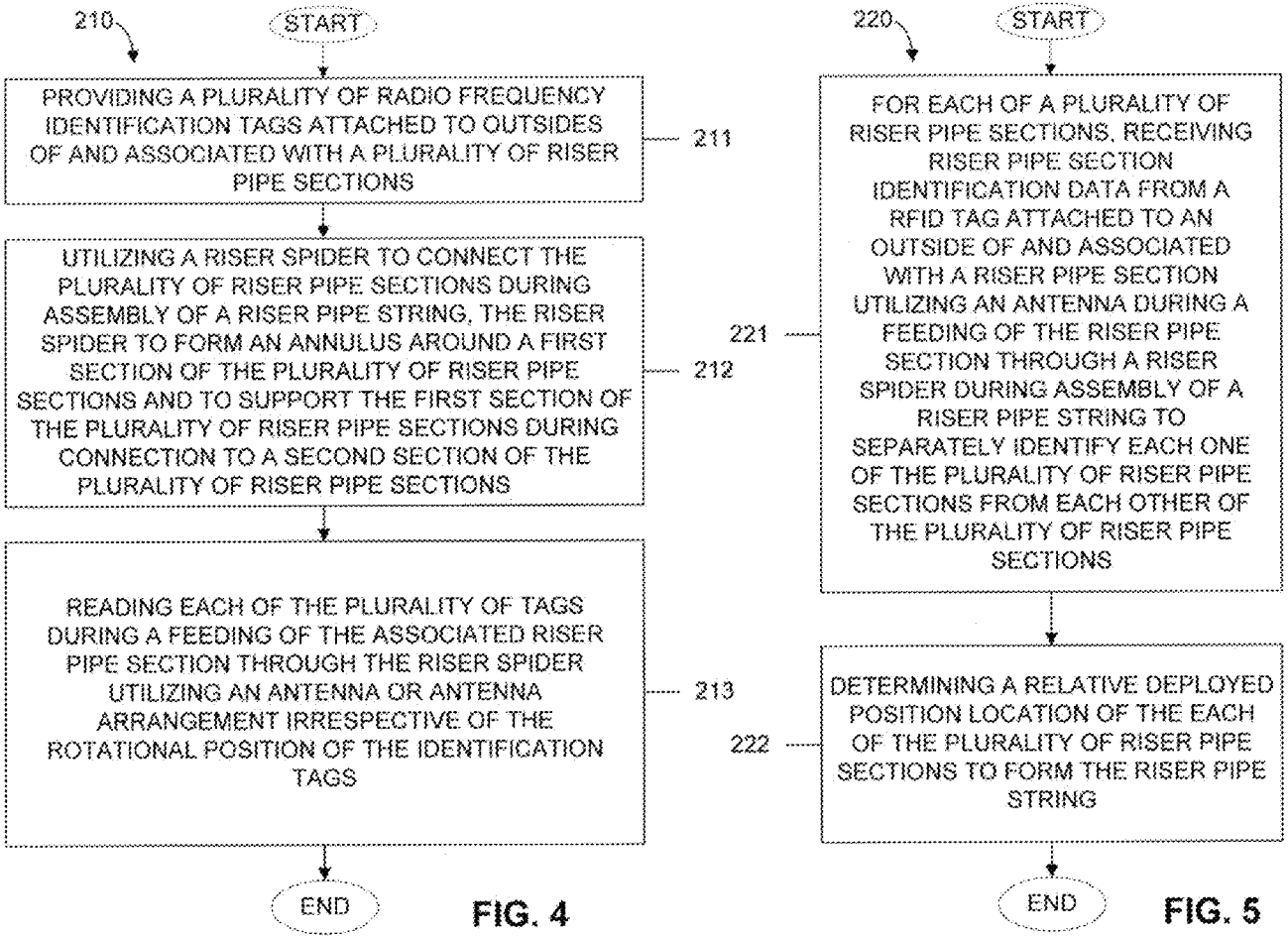
FIG. 4 is a schematic block diagram of method of tracking marine riser pipe sections according to an embodiment of the present invention.
FIG. 5 is a schematic block diagram of method of tracking a plurality of marine riser pipe sections according to an embodiment of the present invention.

As illustrated in FIG. 4, embodiments of the present invention include, for example, a method 210 of tracking marine riser pipe sections 29. The method 210 can include, for example, providing a plurality of radio frequency identification tags 71 attached to outsides of and associated with a plurality of riser pipe sections (211). The method 210 can include, for example, utilizing a riser spider 32 to connect the plurality of riser pipe sections 29 during assembly of a riser pipe string (212). The riser spider can form an annulus around a first section of the plurality of riser pipe sections and support the first section of the plurality of riser pipe sections during connection to a second section of the plurality of riser pipe sections. The method 210 can include, for example, reading each of the plurality of radio frequency identification tags 71 during a feeding of the associated riser pipe section through the riser spider 32 utilizing an antenna (213).

The antenna arrangement can include either of the antenna/antenna designs 161-166, described previously, attached to or embedded within, and substantially spanning along the entire inner-facing surface of a single-section riser spider or a multi-section spider if each sections include joint double connectors connecting any antenna loops traversing the splits between riser sections 32A, 32B; about half of one or both of the inner-facing surface sections of the riser spider 32 defined by the split between riser sections 32A, 32B, so that the respective antenna or antennae follow the contour of respective portions of the riser spider 32.

As illustrated in FIG. 5, embodiments of the present invention include, for example, a. method 220 of tracking a plurality of riser pipe sections 29. The method 220 can include, for example, for each of a plurality of riser pipe sections 29, receiving riser pipe section identification data from a radio frequency identification tag 71 attached to an outside of and associated with a riser pipe section utilizing an antenna during a feeding of the riser pipe section through a riser spider during assembly of a riser pipe string to separately identify each one of the plurality of riser pipe sections from each other of the plurality of riser pipe sections (221). The antenna arrangement can include either of the antenna/antenna designs 161-166, described previously arranged so that the antenna or antennae follow the contour of the inner-facing surface or surfaces of the riser spider. The method 220 can include, for example, determining a relative deployed position location of the each of the plurality of riser pipe sections 29 to form the riser pipe string (222).

FIGS. 1-9 illustrate various portions and optional configurations of an exemplary embodiment of a Riser Lifecycle Monitoring System (RLMS) 30 which provides an integrated tool designed to improve the lifecycle performance of a marine riser through the application of remote diagnostics, online asset management, and readily accessible riser asset maintenance history, and to permit remote management of riser assets, with particular emphasis on riser joints. The riser lifecycle management system includes integrated hardware and software/program product components which can be combined in a central database preferably located on shore. This database can store asset information on every riser lifecycle management system equipped riser in the world. It also can permit transfer of a riser asset from one vessel to another while retaining all historic data. The vessel computers, in turn, can retrieve the data from sensors placed, for example, on each riser asset. The riser lifecycle management system beneficially provides for acquisition of riser load history data. Such acquisition can include gathering sensor data, multiplexing that data, and communicating it through the water column up to a vessel, while allowing for an acceptable level of fault tolerance. The data acquired depends on the type of sensor used on the riser asset. Such data provided by embodiments of the system can also allow for scheduled and unscheduled maintenance and for control of an associated riser tensioning system.

Figure 6:
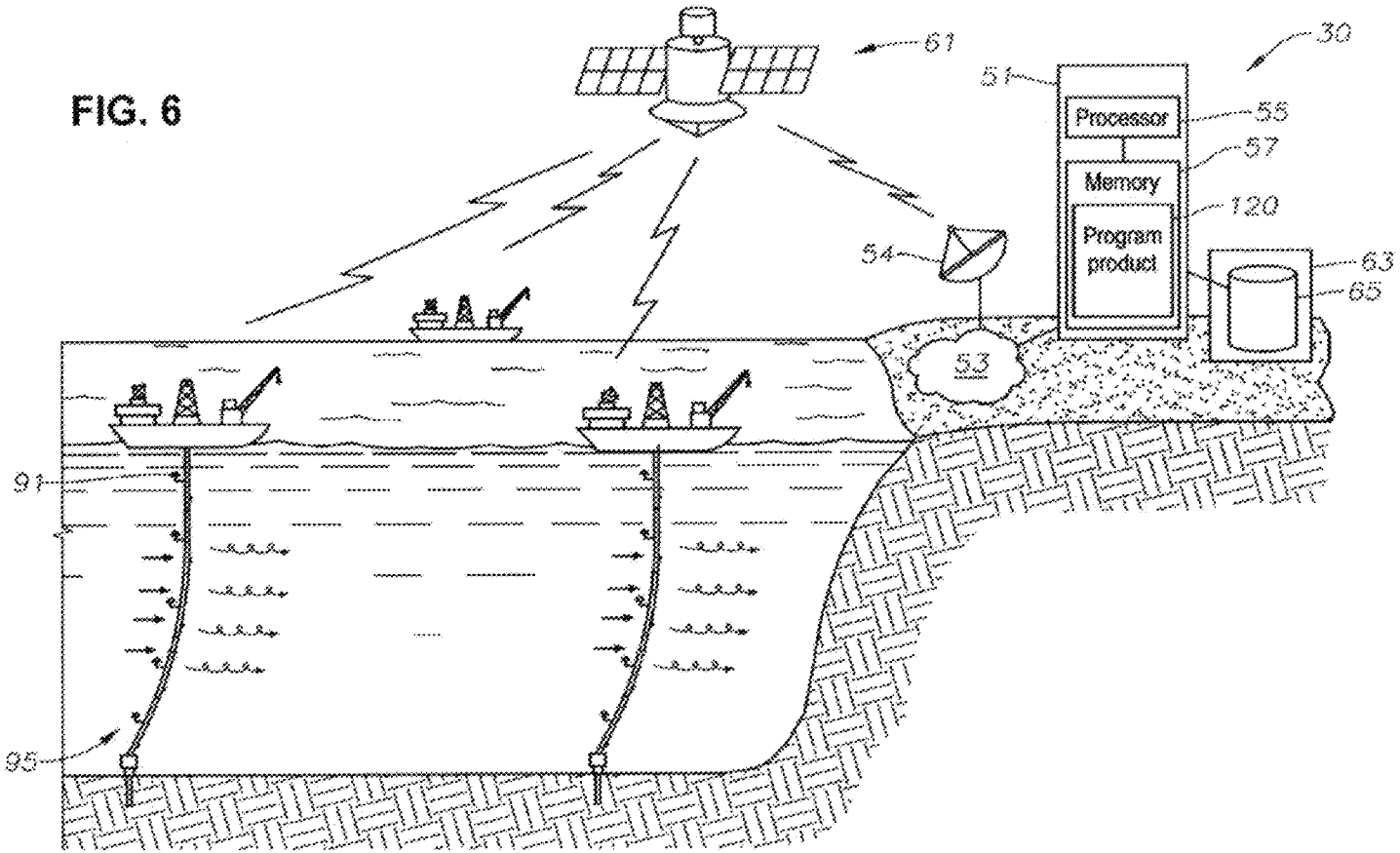
FIG. 6 is an environmental view of a system for monitoring and managing a plurality of marine riser assets according to an embodiment of the present invention.

More specifically, as illustrated in FIGS. 6, 7A, 7B, and 8, the riser lifecycle management system 30 includes portions onshore and portions at each of the vessel locations. As illustrated in FIG. 6, the portion of the riser lifecycle management system 30 located at an onshore or other centralized location or locations can include at least one computer to remotely manage riser assets for a plurality of separate vessel locations defining a riser lifecycle management server 51 positioned in communication with an onshore local area communication network 53. The riser lifecycle management server 51 can include a processor 55 and memory 57 coupled to the processor 55. The memory 57 can include, for example, program product 120. The riser lifecycle management system 30 can also include a data warehouse 63 which can store relevant data on every piece of riser lifecycle management system equipped riser components anywhere in the world. The data warehouse 63 is accessible to the processor 55 of the riser lifecycle management server 51 and can be implemented in hardware, software, or a combination thereof. The data warehouse 63 can include at least one centralized database 65 configured to store asset information for a plurality of riser pipe sections 29, i.e., riser joints, and other riser assets of interest deployed at a plurality of separate vessel locations. The asset information can include, for example, the part number, serial number, relevant manufacturing records, operational procedures, and all maintenance records (including detailed information on the nature of the maintenance), just to name a few. This information is generally keyed into the riser lifecycle management system 30 at the time of manufacture or maintenance. The database 65 can also retain deployment and load history information, which can be acquired automatically from shipboard computers 41 located on each riser lifecycle management system equipped vessel 27. See also, e.g., FIG. 7A.

The riser lifecycle management system 30 can also include riser pipe section measurement instrument modules 91 and a subsurface communication medium 95, described herein.

The riser lifecycle management system 30 can also include, in communication with the onshore communication network 53, a receiver/transmitter 54 providing, for example, satellite-based communication to a plurality of vessels/drilling/production facilities each having a receiver/transmitter 44. The riser lifecycle management system 30 can also include, for example, a global communication network 61 providing a communication pathway between the shipboard computers 41 of each respective vessel 27 and the riser lifecycle management server 51 to permit transfer of riser asset information between the shipboard computers 41 and the riser life cycle management server 51.

Figure 7A:
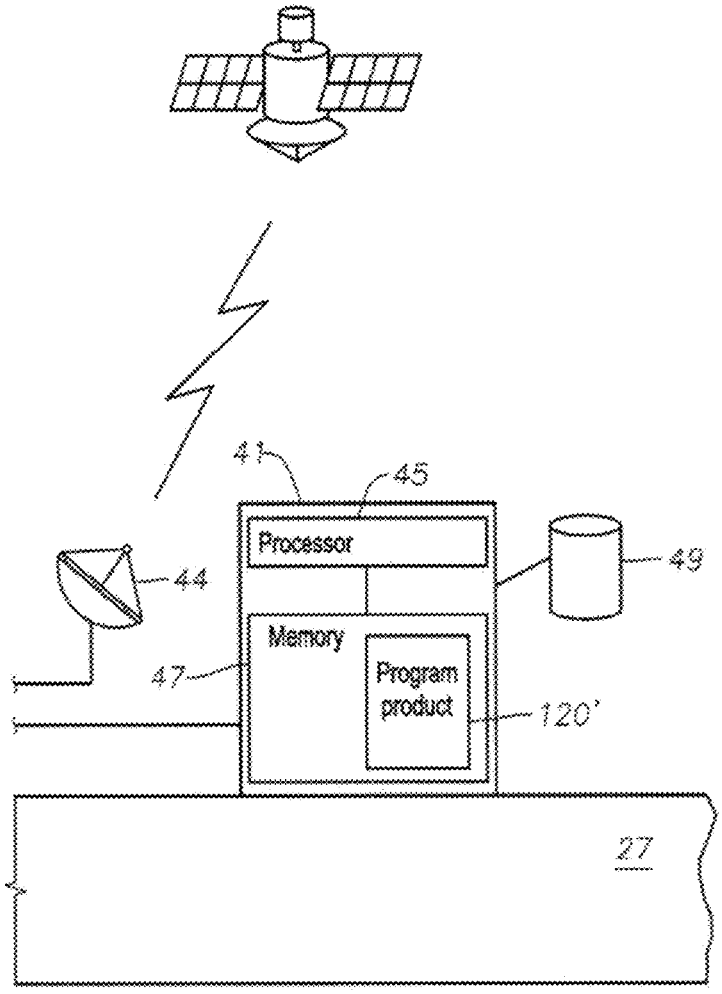
FIGS. 7A-7B are environmental views of a portion of the system for monitoring and managing a plurality of marine riser assets according to an embodiment of the present invention.
Figure 7B:
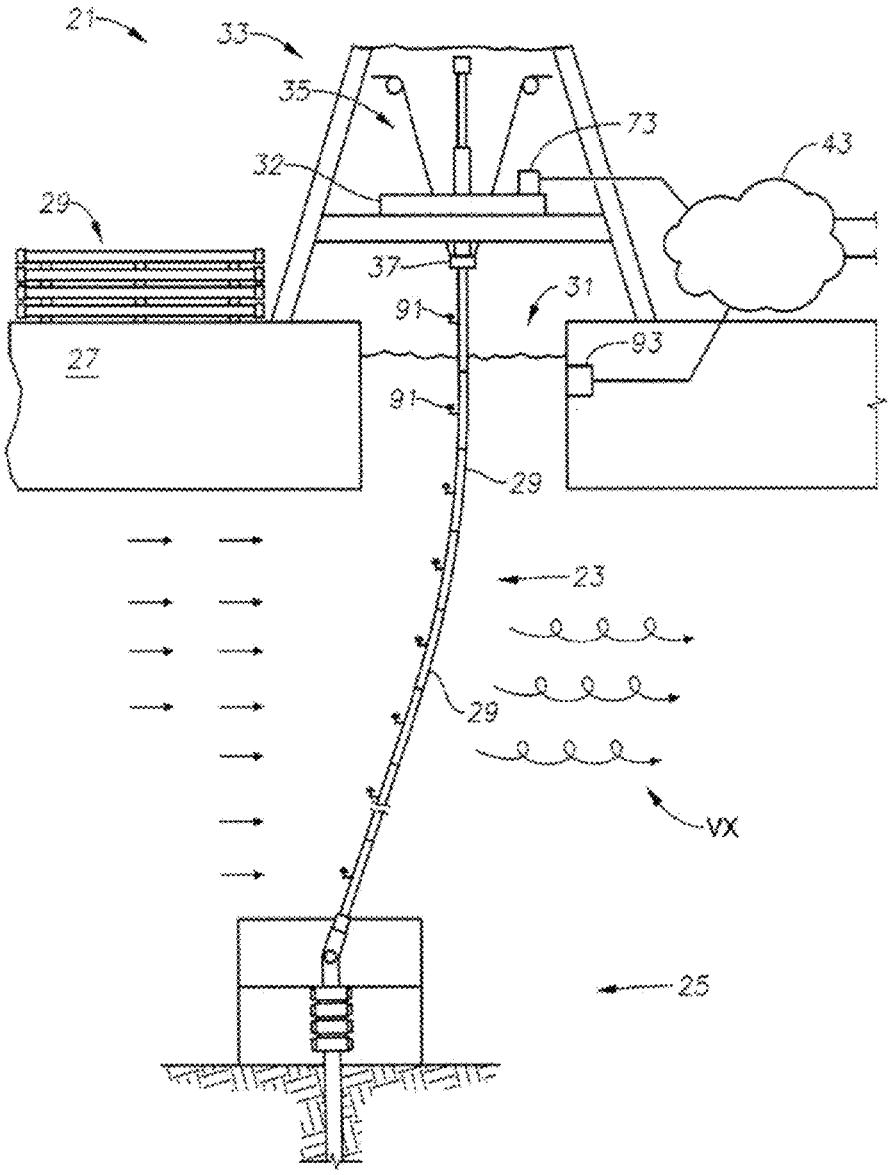
Figure 8:
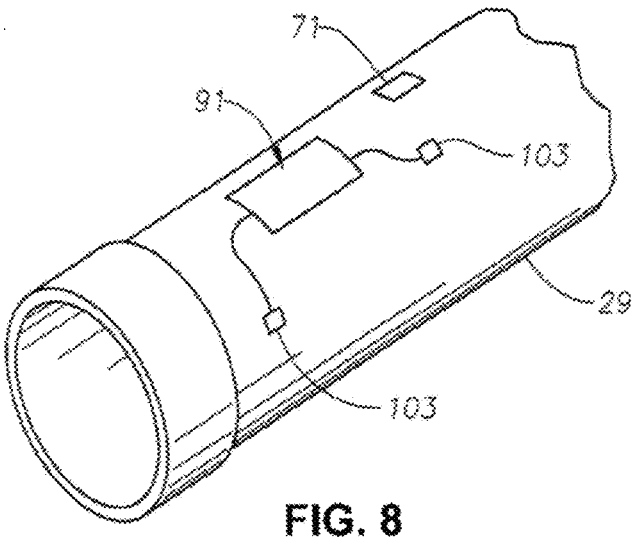
FIG. 8 is a perspective view of a riser joint carrying communication and identification hardware according to an embodiment of the present invention.

As illustrated in FIGS. 7A and 7B, the portion of the riser lifecycle management system 30 located at each at each of the vessel 27 locations can include, for example, a shipboard computer 41 in communication with a local shipboard communication network 43, e.g., LAN, or local area network. The shipboard computer 41 can include a processor 45, and memory 47 coupled to the processor 45. The memory 47 can include, for example, program product 120. At least one database 49 accessible to the processor 45 of a shipboard computer 41 is also provided which can be used to store asset information for each of the plurality of riser joints deployed from the vessel 27. Such asset information can include riser joint identification data, riser joint deployment and location data, and riser joint load history data. Also in communication with the shipboard communication network 43 is a receiver/transmitter 44 providing, for example, satellite-based communication to onshore facilities.

As illustrated in FIG. 7B, the riser lifecycle management system 30 can include offshore drilling and/or production system 21, including a deployed riser pipe or conductor defining a riser string 23 extending between subsea wellhead system 25 and a floating vessel 27, such as, for example, a dynamically positionable vessel. The riser string 23 includes multiple riser sections or joints 29 connected together, for example, by a bolted flange or other means known to those skilled in the art. The vessel 27 includes a well bay 31 extending through a floor of the vessel 27, and typically includes a riser spider 32 positioned on an operational platform 33 in a well bay 31 to support the riser string 23 when riser joint connections are being made or broken during running or retrieval of the riser string 23. Embodiments of the present invention apply to both drilling and production risers. The vessel 27 also includes a tensioning system 35, located on the operational platform 33, which provides both lateral load resistance and vertical tension, preferably applied to a slip or tensioning ring 37 attached to the top of the riser string 23.

According to an embodiment of the present invention, the riser identification and deployment data for each riser joint 29 (or other riser asset of interest) is communicated, for example, to the shipboard computer 41 by means of a tag such as, for example, an RFID chip or tag 71 (see, e.g., FIG. 8) positioned on each riser joint 29, and an appropriate reader 73, for example, mounted on deck or otherwise connected to the vessel 27 at or adjacent the surface of the sea and operably coupled to or otherwise in communication with the shipboard computer 41 through the local shipboard communication network 43.

Further, the system 30 can also include riser joint measurement instrument modules 91 each positioned to sense a load represented by strain, riser pipe curve, or accelerometer data, etc., imposed on a separate one of the riser joints 29 forming the riser string 23, a riser joint load data receiver 93 mounted or otherwise connected to the vessel 27 at or adjacent the surface of the sea and operably coupled to the local shipboard communication network 43 to receive load data for each of the deployed riser joints 29 from the riser joint measurement instrument modules 91, and a subsurface communication medium 95 illustrated as provided via a series of replaceable wireless data telemetry stations providing a communication pathway between each of the joint measurement instrument modules 91 and the riser joint load data receiver 93 through a water column associated with the riser string 23.

The measurement instrument modules 91 can determine the magnitude of the loads imposed on the riser string 23 to calculate the magnitude of the stress at various locations on the riser joint 29 or other riser asset. Examples can include excessive stresses, deflections, accelerations, and high frequency alternating stresses in a cross flow motion due to, for example, vortex induced vibration caused by vortices VX. There are a number of methods under which the riser stresses can be measured. In one embodiment, the riser pipe strain is read at a sensor 103, since conversion of strain data to stresses is fairly straightforward and can be done via a relatively simple computer program element. Alternatively, the riser dynamics can be obtained via accelerometers, which may require a more complex set of operations for conversion to material stress from which the operational (e.g., fatigue) life can then be calculated. The load data sent to the riser lifecycle management server 51 can be in either raw data or converted to local stresses by the shipboard computer 41, or some intermediate form if some processing is accomplished by the instrument modules 91. According to an embodiment of the present invention, the sensor 103 is carried by a thin clamp-on composite mat (not shown), which can be used to accurately determine the deflection in the riser joint 29.

Embodiments of the riser lifecycle management system 30 can also include various methods relating to monitoring and managing a plurality of marine riser assets. For example, the shipboard computer 41 can compare ID data with the list of recently recorded tags. If a duplicate asset is reported, it is disregarded. That is, when utilizing automated reading sensors, the same riser asset may be scanned multiple times while being landed on the spider 32 or during the normal course of handling. As such, the preferred handling procedures can include disregarding duplicate records or duplicate reads within a preselected time period.

Embodiments of the apparatuses and associated methods according to the present invention provide several advantages and enhancements, in the context of a riser lifecycle management system 30. For example, embodiments provide for automatically reading identification tags on riser pipes, without requiring hand-held readers, manual processes, or interference with normal operations. That is, embodiments provide a low frequency (LF), stationary reader antenna built into a riser spider that allows riser pipes to be read automatically, as the pipes are fed through the riser spider.

In conjunction with a riser lifecycle management system 30, embodiments of the present invention can track marine riser pipe sections to thereby enable the system to notify automatically an operator of both routine and unscheduled maintenance events. A routine maintenance event is one that is scheduled sometime in advance, but may have been aided by load history information in the database. An unscheduled maintenance event is one associated with an unexpected incident. For example, one or more riser joints in a string that has been subjected to a direct hit by a hurricane may reach a preset fatigue life trigger level, requiring an inspection of the riser joint at the very least. In such a scenario, the operator would have a high degree of confidence that the remaining riser assets are suitable for marine deployment, reducing the down time associated with inspection of the entire riser string.

This application is a continuation-in-part of and claims priority to and the benefit of: U.S. patent application Ser. No. 13/919,573, titled "Oil and Gas Riser Spider with Low-Frequency Antenna Apparatus and Method," which is a continuation of and claims priority to and the benefit of U.S. patent application Ser. No. 12/710,707, titled "Oil and Gas Riser Spider with Low-Frequency Antenna Apparatus and Method"; and U.S. patent application Ser. No. 13/707,121, titled. "Riser Lifecycle Management System, Computer Readable Medium and Program Code," which claims priority to and the benefit of U.S. application Ser. No. 13/300,155, titled "Riser Lifecycle Management System, Program Product, and Related Methods," which claims priority to and the benefit U.S. patent application Ser. No. 12/029,376, titled "Riser Lifecycle Management System, Program Product, and Related Methods," filed on Feb. 11, 2008, now U.S. Pat. No. 8,074,720, and is related to co-owned U.S. Pat. No, 7,328,741 B2, titled "System for Sensing Riser Motion" issued on Feb. 12, 2008, each incorporated herein by reference in its entirety.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. An offshore drilling apparatus comprising:

a riser spider for supporting a plurality of riser pipe sections during assembly of a riser pipe string, the riser spider forming an annulus around a first riser pipe section of the plurality of riser pipe sections being deployed therethrough and supporting the first riser pipe section during connection to a second riser pipe section of the plurality of sections, each riser pipe section having an identification tag attached to or embedded within an outer-facing surface of the respective riser pipe section;

an antenna arrangement comprising an antenna attached to or embedded within a substantial portion of an inner-facing surface of the riser spider and configured so that the antenna at least substantially follows the contour of the substantial portion of the inner-facing surface of the riser spider; and a reader operably connected to the antenna arrangement for reading the plurality of radio frequency identification tags attached to the respective outer-facing surfaces of the plurality of riser pipe sections.

2. The apparatus as defined in claim 1, wherein the antenna arrangement is configured to provide for reading the identification tag of each of the plurality of riser pipe sections being deployed through the riser spider at any rotational orientation of the respective riser pipe section in relation to a rotational orientation of the riser spider with at least approximately a 96% reliability.

3. The apparatus as defined in claim 1, wherein each of the plurality of riser pipe sections include at least two circumferentially offset identification tags, and wherein the antenna arrangement is configured to provide for reading at least one of the identification tags of each of the plurality of riser pipe sections being deployed through the riser spider at any rotational orientation of the respective riser pipe section in relation to a rotational orientation of the riser spider with 100% reliability.

4. The apparatus as defined in claim 1, wherein the antenna arrangement includes a plurality of antenna loops arranged circumferentially along the inner-facing surface of the riser spider.

5. The apparatus as defined in claim 4, wherein the plurality of antenna loops have a minimum gap spacing to prevent undesired coupling and a corresponding interconnecting geometry between adjacent antenna loops resulting in an absence of a vertical line separation along a longitudinal axis of the riser spider between the adjacent antenna loops.

6. The apparatus as defined in claim 1, wherein the riser spider comprises two portions that together close around the outer-facing surface of each respective riser pipe section being deployed therethrough; and wherein the antenna comprises one or more antenna loops that substantially completely span circumferentially along the inner-facing surface of a first of the two portions of the riser spider.

7. The apparatus as defined in claim 6, wherein the antenna arrangement further comprises:

a second antenna comprising one or more antenna loops that substantially completely span circumferentially along the inner-facing surface of a second of the two portions of the riser spider.

8. The apparatus as defined in claim 1, wherein the antenna comprises a single antenna loop that substantially completely spans circumferentially approximately 360° along the inner-facing surface of the riser spider.

9. The apparatus as defined in claim 1, wherein the antenna comprises a plurality of antenna loops that substantially completely span circumferentially approximately 360° along the inner-facing surface of the riser spider.

10. The apparatus as defined in claim 1, further comprising:

the plurality of riser pipe sections;

wherein the riser spider comprises two portions that together close around the outer-facing surface of each respective riser pipe section being deployed there through;

wherein the antenna arrangement is employed on only the first of the two portions of the riser spider;

wherein the antenna comprises one or more antenna loops that substantially completely span circumferentially along the inner-facing surface of a first of the two portions of the riser spider; and wherein each of the riser pipe sections carries at least two identification tags spaced circumferentially apart greater than approximately 90° but less than approximately 270° apart to ensure read reliability.

11. An apparatus, comprising:

a riser spider for supporting a plurality of tubulars during assembly of a tubular string, the riser spider forming an annulus around a first tubular of the plurality of tubulars being deployed therethrough and supporting the first tubular during connection to a second tubular of the plurality of tubulars, each tubular having an identification tag attached to or embedded within an outer-facing surface of the respective tubular; and an antenna arrangement comprising an antenna attached to or embedded within a substantial portion of an inner-facing surface of the riser spider and configured so that the antenna at least substantially follows the contour of the substantial portion of the inner-facing surface of the riser spider.

12. The apparatus as defined in claim 11, further comprising:

a reader operably connected to the antenna arrangement for reading the plurality of radio frequency identification tags attached to the respective outer-facing surfaces of the plurality of tubulars; and a computer configured to determine a relative deployed position location of the each of the plurality of tubulars that form the tubular string.

13. The apparatus as defined in claim 11, wherein the antenna arrangement is configured to provide for reading the identification tag of each of the plurality of tubulars being deployed through the riser spider at any rotational orientation of the respective riser pipe section in relation to a rotational orientation of the riser spider with at least approximately a 96% reliability.

14. The apparatus as defined in claim 11, wherein each of the plurality of tubulars include at least two circumferentially offset identification tags, and wherein the antenna arrangement is configured to read at least one of the identification tags of each of the plurality of tubulars being deployed through the riser spider at any rotational orientation of the respective riser pipe section in relation to a rotational orientation of the riser spider with 100% reliability.

15. The apparatus as defined in claim 11, wherein the antenna arrangement includes a plurality of antenna loops arranged circumferentially along the inner-facing surface of the riser spider.

16. The apparatus as defined in claim 15, wherein the plurality of antenna loops have a minimum gap spacing to prevent undesired coupling and a corresponding interconnecting geometry between adjacent antenna loops resulting in an absence of a vertical line separation along a longitudinal axis of the riser spider between the adjacent antenna loops.

17. The apparatus as defined in claim 11, wherein the antenna comprises a plurality of antenna loops that substantially completely span circumferentially approximately 360° along the inner-facing surface of the riser spider.

18. The apparatus as defined in claim 11, further comprising:

the plurality of riser pipe sections;

wherein the riser spider comprises two portions that together close around the outer-facing surface of each respective riser pipe section being deployed there through;

wherein the antenna arrangement is employed on only the first of the two portions of the riser spider;

wherein the antenna comprises one or more antenna loops that substantially completely span circumferentially along the inner-facing surface of a first of the two portions of the riser spider; and wherein each of the riser pipe sections carries at least two identification tags spaced circumferentially apart greater than approximately 90° but less than approximately 270° apart to enhance read reliability.

19. A method of tracking marine riser pipe sections, the method comprising the steps of:

providing a plurality of radio frequency identification tags attached to or embedded within an outer-facing surface of a plurality of riser pipe sections, with each of the plurality of riser pipe sections carrying one or more of the plurality of radio frequency identification tags;

attaching an antenna arrangement to or embedding the antenna arrangement within a substantial portion of an inner-facing surface of a riser spider, the antenna arrangement comprising an antenna configured so that the antenna at least substantially follows the contour of the substantial portion of the inter-facing surface of the riser spider;

utilizing the riser spider to connect the plurality of riser pipe sections during assembly of a riser pipe string, to include lowering a first riser pipe section of the plurality of riser pipe sections into the riser spider, supporting the first riser pipe section with the riser spider, and connecting a second riser pipe section of the plurality of riser pipe sections to the first riser pipe section, and repeating to make up the riser pipe string; and reading at least one of the one or more of the plurality of radio frequency identification tags during a feeding of the associated riser pipe section through the riser spider by utilizing the antenna.

20. A method as defined in claim 19, wherein the antenna arrangement comprises a plurality of antenna loops arranged circumferentially along the inner-facing surface of the riser spider; and wherein the plurality of antenna loops have a minimum gap spacing to prevent undesired coupling and a corresponding interconnecting geometry between adjacent antenna loops resulting in an absence of a vertical line separation along a longitudinal axis of the riser spider between the adjacent antenna loops.

21. A method as defined in claim 19, wherein each of the plurality of riser pipe sections include at east two circumferentially offset identification tags; and wherein the antenna arrangement is configured to read at least one of the identification tags of each of the plurality of riser pipe sections being deployed through the riser spider at any rotational orientation of the respective riser pipe section in relation to a rotational orientation of the riser spider with 100% reliability.

22. A method as defined in claim 19, wherein the riser spider comprises two portions that together close around the outer-facing surface of each respective riser pipe section being deployed therethrough, adjacent the antenna;

wherein the antenna arrangement is employed on only the first of the two portions of the riser spider;

wherein the antenna arrangement comprises one or more antenna loops that substantially completely span circumferentially along the inner-facing surface of a first of the two portions of the riser spider; and wherein each of the riser pipe sections carries at least two identification tags spaced circumferentially apart greater than approximately 90° but less than approximately 270° apart to enhance read reliability.

* * * * *